US009462855B1

(12) United States Patent
Curran

(10) Patent No.: US 9,462,855 B1
(45) Date of Patent: Oct. 11, 2016

(54) DEVICE WITH INTERCHANGEABLE MEDIA PANEL

(71) Applicant: Timothy M. Curran, Brooklyn, NY (US)

(72) Inventor: Timothy M. Curran, Brooklyn, NY (US)

( * ) Notice: Subject to any disclaimer, the term of this patent is extended or adjusted under 35 U.S.C. 154(b) by 139 days.

(21) Appl. No.: 14/154,523

(22) Filed: Jan. 14, 2014

(51) Int. Cl.
*A44C 5/00* (2006.01)

(52) U.S. Cl.
CPC ..... *A44C 5/0007* (2013.01)

(58) Field of Classification Search
None
See application file for complete search history.

(56) References Cited

U.S. PATENT DOCUMENTS

| | | | | |
|---|---|---|---|---|
| 2,462,425 | A | 2/1949 | Pratt et al. | |
| 3,586,220 | A * | 6/1971 | Reinsberg | 224/221 |
| 4,377,047 | A | 3/1983 | Adams, Jr. et al. | |
| 5,050,276 | A | 9/1991 | Pemberton | |
| 5,347,733 | A | 9/1994 | Whittington | |
| 5,369,854 | A | 12/1994 | Stephens | |
| 5,432,986 | A | 7/1995 | Sexton | |
| 5,592,767 | A | 1/1997 | Treske | |
| 5,758,443 | A | 6/1998 | Pedrazzini | |
| 6,282,760 | B1 | 9/2001 | Mars | |
| 6,349,568 | B1 | 2/2002 | Ito | |
| 6,381,985 | B1 | 5/2002 | Burgard | |
| 6,594,934 | B1 * | 7/2003 | Wong | 40/743 |
| 6,742,359 | B1 | 6/2004 | Takessian | |
| 7,930,918 | B2 | 4/2011 | Bashan et al. | |
| 8,336,240 | B2 | 12/2012 | Gray et al. | |
| 2003/0106336 | A1 | 6/2003 | Gaskill | |
| 2007/0251269 | A1 | 11/2007 | Grosser-Samuels et al. | |
| 2013/0084412 | A1 | 4/2013 | Parker | |

FOREIGN PATENT DOCUMENTS

| | | |
|---|---|---|
| EP | 1651074 | 5/2006 |

* cited by examiner

*Primary Examiner* — Jack W Lavinder
(74) *Attorney, Agent, or Firm* — Robert C. Montgomery; Montgomery Patent & Design, LP.

(57) ABSTRACT

An ornamental device includes a two-part curvilinear member, preferably having a band affixed to either end. Each band is provided with complementary fasteners to enable securing the device about a user's wrist, ankle, or arm. An inner side of the member is provided with a thin, transparent cover that is flexible and resilient. When the cover is pulled from the curvilinear member, the cover forms an arcuate shape that mirrors the arcuate shape of the curvilinear member while still being attached. In this position, it enables a user to insert a paper bearing a reading between the cover and curvilinear member. Forcing the cover back against the curvilinear member allows the cover to hold the paper reading in place.

20 Claims, 4 Drawing Sheets

DEVICE WITH INTERCHANGEABLE MEDIA PANEL

RELATED APPLICATIONS

There are no current pending applications.

FIELD OF THE INVENTION

The present invention relates to an ornamental device that enables retention and display of interchangeable media panels, and is envisioned to be employed as a jewelry piece.

BACKGROUND OF THE INVENTION

Individuals are continuously looking for new and better ways to express themselves. Whether ostentatious or modest, jewelry has long been the sinew of individualized artistic expression. Sporting a jewelry piece carries with it many connotations, ranging from unsophisticated to bourgeois and functional to fanciful. The manifestation of expression, coupled with the interpretations of that expression, is what makes jewelry such a prized possession. An individual can make a strong statement by artfully exploiting interpretations of expressive form and reducing them to a jewelry piece for display. A problem with most jewelry, however, is the lack of versatility. A jewelry piece is typically designed to make a single, or at least a very narrow, statement. It would be advantageous to have a jewelry piece that provides the versatility of making different statements, but without detracting from the perception of uniqueness. It would be further advantageous to enable a jewelry piece to display personalized messages in an artistic fashion, and interchange such messages at the discretion of the user. The development of the present invention fulfills this need.

The invention is a device used to retain and display a media panel, such as a piece of paper bearing a reading. It is envisioned for the device to be used as a portion of a bracelet and worn about a user's wrist, ankle, or arm. The device comprises a two-member configuration, wherein a flexible film member is affixed to an inner surface of a rigid member. The inner surface has a curvilinear shape that is exploited to manipulate the film member into a convex bow shape or a concave bow shape. In a convex shape, the film exposes the inner surface so that a media panel may be inserted between the film and inner surface. In a concave shape, the film abuts the inner surface and retains the media panel that has been inserted. It is envisioned for the flexible film member and the rigid member to comprise a transparent material so as to display any writing or markings of the media panel.

Prior art in this field consists of bracelets and necklaces with interchangeable pendants and ornamental pieces. This prior art has a base structure that serves as the bracelet or necklace, and is provided with a fastening means to removably attach various designer ornaments to a surface of the base structure. Other prior art consists of bracelets and necklaces made from a plurality of interchangeable linkages that enable users to change the appearance of the jewelry piece by substituting one (1) linkage for another.

It is an objective of this invention to improve the versatility of a jewelry piece without detracting from its uniqueness by providing an ornamental device to be used as a piece of jewelry that enables a user to personalize the jewelry at the discretion of the user.

It is a further objective of this invention to provide a means to retain and display a media panel bearing personalized messages within the device.

It is a further objective of this invention to provide a means to quickly and easily interchange the retained medial panel at the discretion of the user.

It is a further objective of this invention to provide a border to a portion of the device that serves as a decoration and an open-assist to improve functionality.

SUMMARY OF THE INVENTION

The invention is a device configured to retain and display a media panel bearing a message. It is envisioned for this device to serve as a jewelry piece, preferably a bracelet; however, it is certainly not limited to such use. The device comprises a curvilinear plate with a film panel connected to a rear surface thereof. At least the rear surface of the curvilinear plate is provided with an arcuate shape, and the film panel is connected to the rear surface at the distal ends of each haunch section. The curvilinear plate is preferably a rigid, transparent material, whereas the film panel comprises a resilient, flexible material. It is envisioned for the curvilinear plate and the film panel to come in a variety of shapes; however, it is preferred that they share similar perimeter shapes.

The film panel is connected to the curvilinear plate at the distal ends of each haunch section of the arcuate shape by fasteners so as to secure them in a parallel manner and to create a bowing-effect upon the film panel. The compression force upon the film panel either forces the film panel to bow towards the curvilinear plate or away from the curvilinear plate. When the film panel is pulled away from the curvilinear plate, the compressive forces compel the film panel to bow away from the rear surface of the curvilinear plate, thereby exposing the rear surface. A media panel is then inserted between the rear surface and the film panel. The film panel is then pushed towards the curvilinear plate, whereby the compressive forces compel the film panel to bow towards the rear surface and pin the media panel between the two (2) surfaces. The preferred transparent nature of the curvilinear plate and the film panel enable display of the media message through the device.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
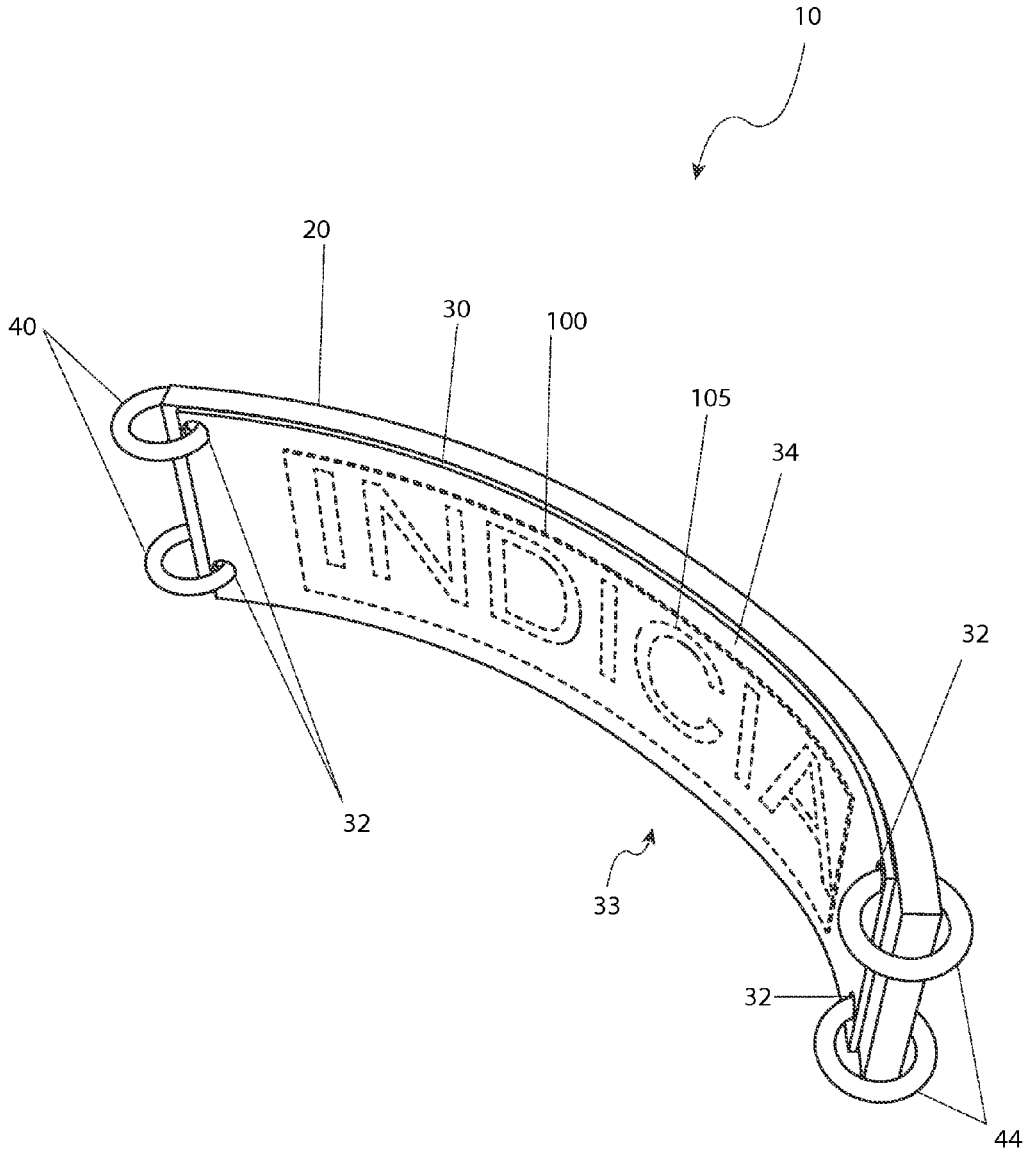
FIG. 1 is a rear perspective view of a bracelet plate with a message holding means 10, according to a preferred embodiment of the present invention.

10 bracelet
20 plate
22 plate aperture
23 plate rear surface
24 plate indicia
25 plate front surface
30 film panel
32 film panel aperture
33 film panel rear surface
34 film panel border
35 film panel front surface
40 first ring
44 second ring
50 alternate bracelet embodiment
60*a* first bracelet section
60*b* second bracelet section
62 clasp
100 media panel
105 message indicia

DETAILED DESCRIPTION OF THE PREFERRED EMBODIMENT

Figure 2:
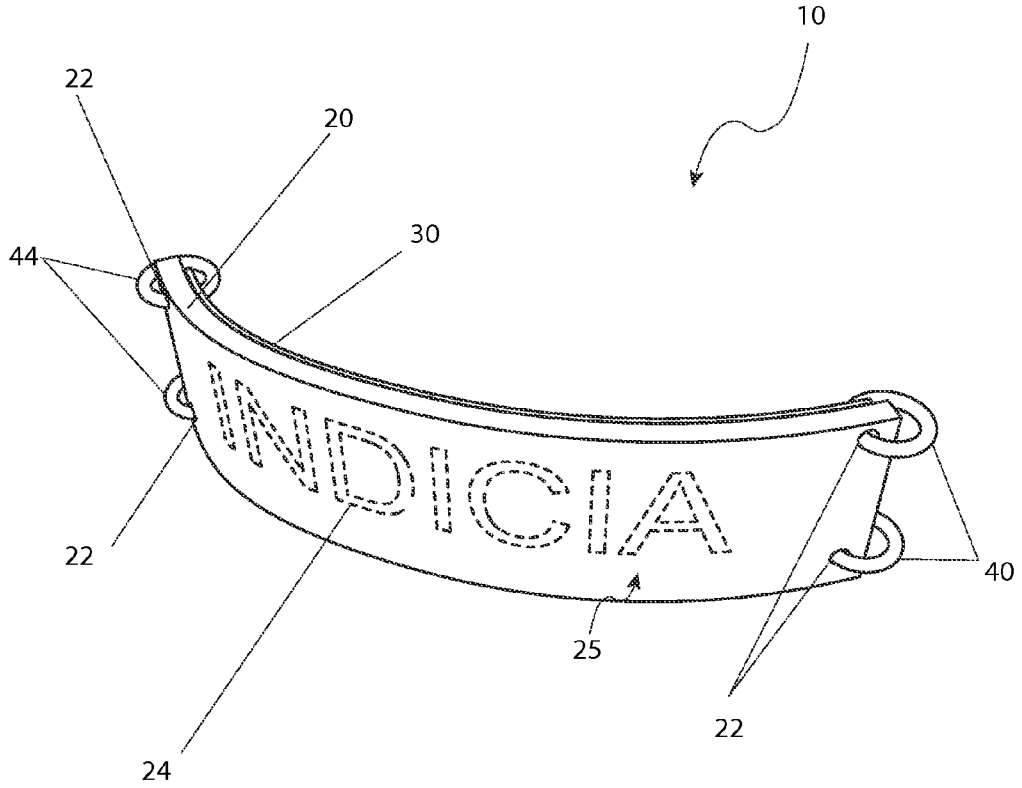
FIG. 2 is a front perspective view of the bracelet plate 10, according to a preferred embodiment of the present invention.
Figure 3A:
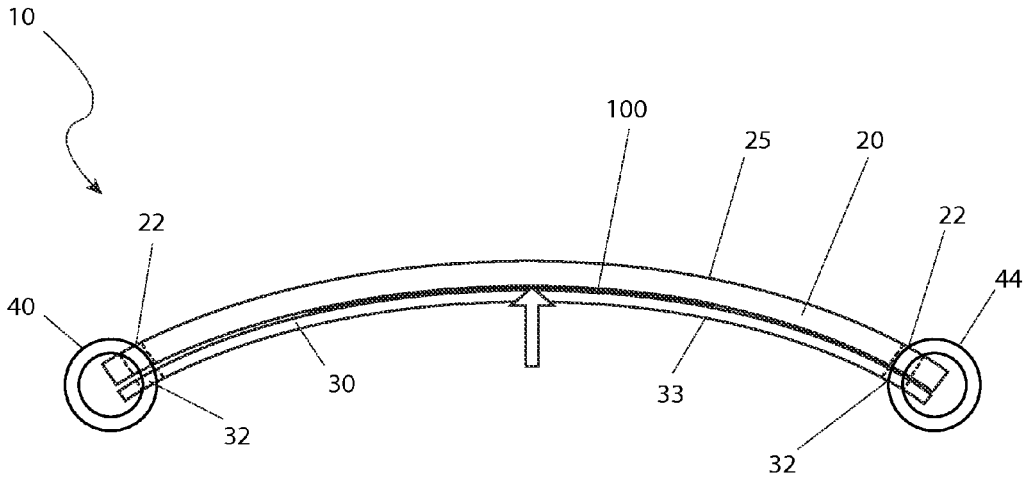
FIG. 3*a* is a top view of the bracelet plate 10 depicting a closed state, according to a preferred embodiment of the present invention.
Figure 3B:
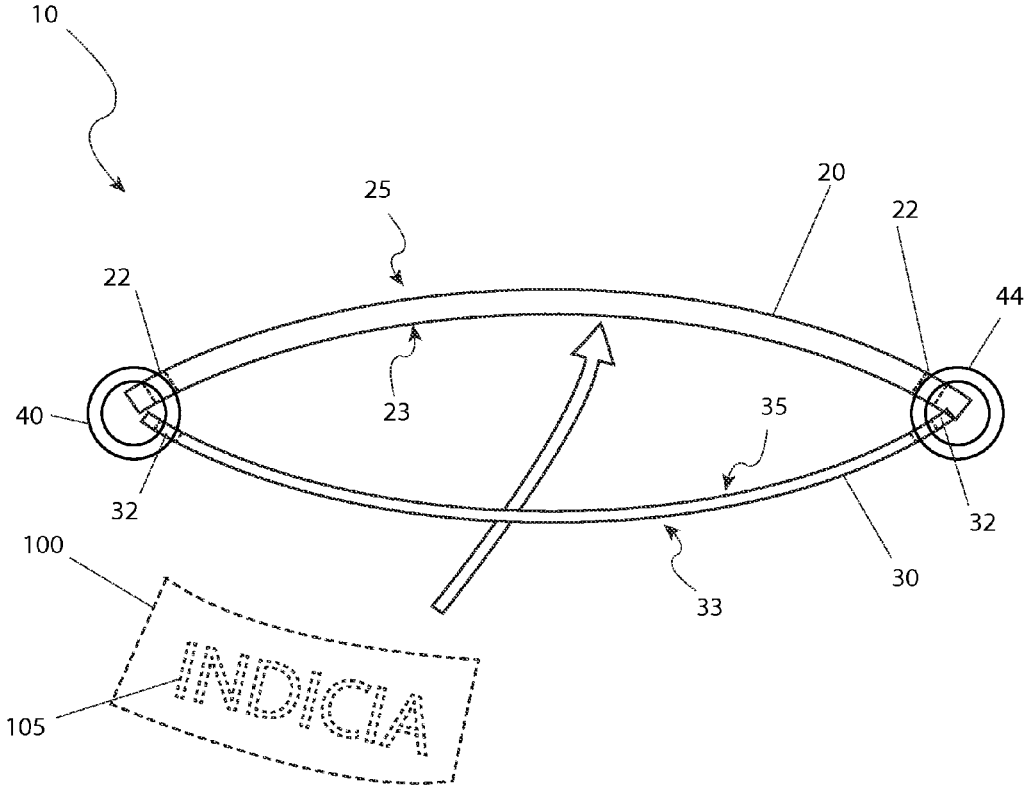
FIG. 3*b* is a top view of the bracelet plate 10 depicting an open state, according to a preferred embodiment of the present invention; and, FIG. 4 is an alternate bracelet embodiment 50 depicting the bracelet plate 20 affixed to bracelet sections 60*a*, 60*b*, according to an alternate embodiment of the present invention.
Figure 4:
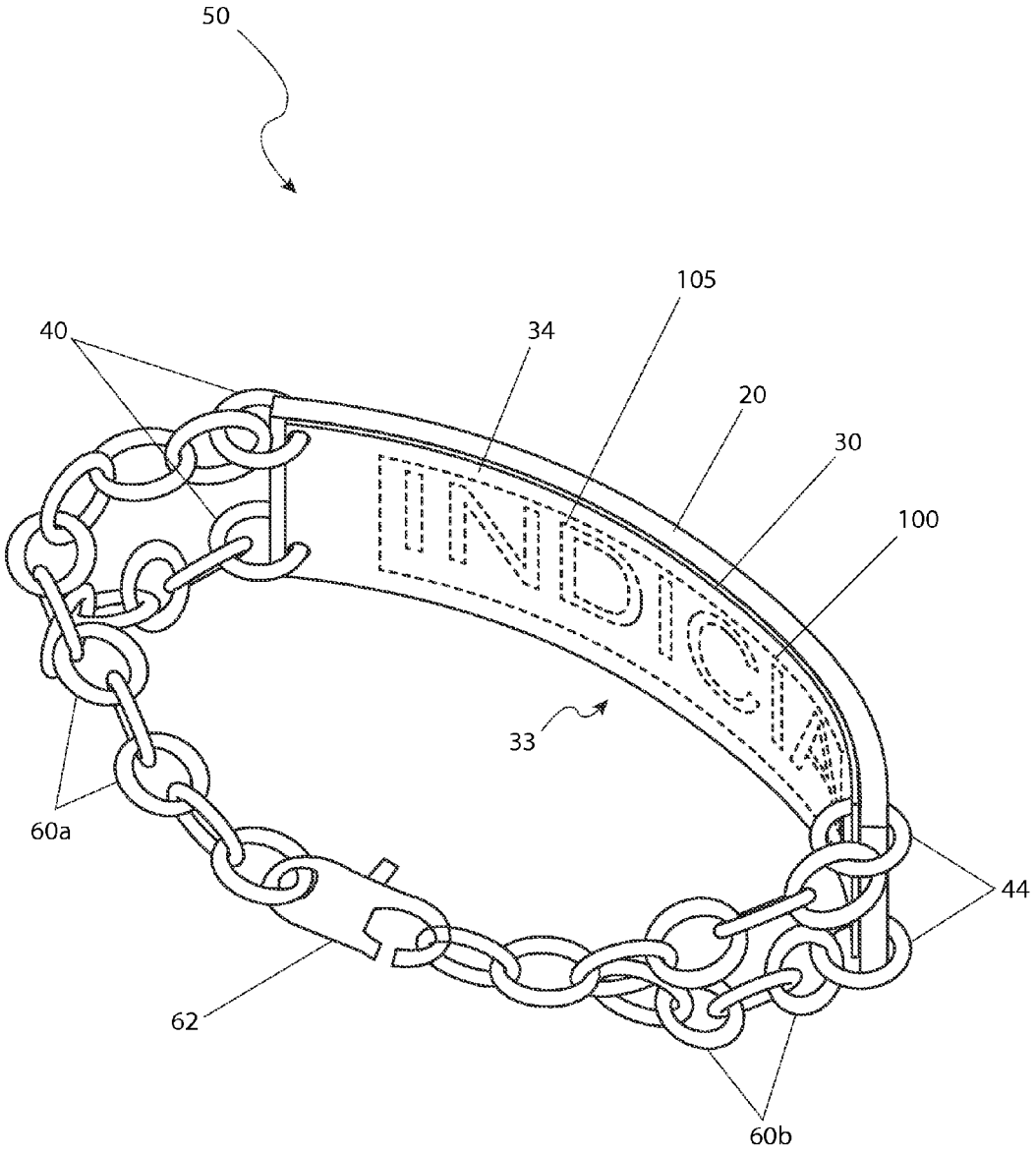

The best mode for carrying out the invention is presented in terms of its preferred embodiment 10, herein depicted within FIGS. 1 through 3*b* and in terms of an alternate embodiment 50, herein depicted in FIG. 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a bracelet with message holding means (herein described as the "device") 10, which provides a plate 20 and a film panel 30 configured to entrap a media panel 100 envisioned to contain an inspiring message or other uplifting visual message indicia 105 in a convenient location for viewing when desired.

Referring now to FIGS. 1 and 2, rear and front perspective views of the device 10, according to the preferred embodiment of the present invention, are disclosed. The device 10 includes a curvilinear plate 20 having a connected film panel 30, where the film panel front surface 35 is positioned forcibly against a rear surface portion 23 of the plate 20 in a parallel manner, thereby clamping the inserted the media panel 100 between.

The plate 20 is envisioned to provide a curvilinear member having arcuate rear 23 surface being designed to comfortably partially wrap around a user's wrist area if so utilized (see FIG. 4). The front surface 25 is preferably configured to also have an arcuate shape. The plate 20 is envisioned being made of a rigid plastic or metal material and is envisioned to include a printed, etched, or otherwise applied wrist plate indicia 24 upon a front surface portion 25. The wrist plate indicia 24 is envisioned to provide decorative designs and patterns, as well as med-alert symbols, script or logos based upon a user's preference such as, but not limited to, sports names/logos, personal names, symbols, pictures, and the like, to further customize and personalize the device 10.

The film panel 30 is envisioned to be made of flexible transparent plastic material such as extruded polycarbonate sheet or equivalent material and also includes a rear 33 and front 35 surface. The film panel 30 further includes a screen-printed or foil-stamped silver film panel border 34 intended to decoratively surround the message indicia 105 upon the media panel 100.

A particular embodiment of the device 10 is illustrated here having rectangular-shaped plate 20 and film panel 30 portions; however, it is understood that the portions of the device 10 may be introduced having various perimeter shapes such as oval, elliptical, polygonal, and the like, without deviating from the teachings of the invention, and as such should not be interpreted as a limitation of scope. The plate 20 and the film panel 30 are to have similar perimeter shapes and are affixed to each other via a pair of metallic first rings 40*a* along one (1) side edge, and a pair of metallic second rings 40*b* located along an opposing side edge. The first 40*a* and second 40*b* rings pass jointly through respective pairs of plate apertures 22 and pairs of film panel apertures 32 to attach and position the film panel 30 in a parallel manner with regards to the plate 20. The apertures 22, 32 and rings 40*a*, 40*b* are particularly positioned so as to create a compressing and bowing-effect upon the film panel 30, thereby holding the film panel 30 in compression against the plate 20.

Referring now to FIGS. 3*a* and 3*b*, top views of the device 10 depicting closed and open states, according to the preferred embodiment of the present invention, are disclosed. The device 10 clamps the media panel 100 between the plate 20 and the film panel 30 and allows a user to observe a message indicia 105 printed upon the media panel 100, when desired. The media panel 100 may be quickly replaced by manually flexing the film panel 30 away from the plate 20 to an open position as seen in FIG. 3*b*; inserting another media panel 100 containing a different message indicia 105; and, returning the film panel 30 to a closed state against the plate 20 as seen in FIG. 3*a*.

Referring now to FIG. 4, an alternate bracelet embodiment 50 depicting the device 10 affixed to bracelet sections 60*a*, 60*b*, according to an alternate embodiment of the present invention, is disclosed. An alternate embodiment 50 of the device 10 is illustrated here having an affixed first bracelet section 60*a* at one (1) end portion being mechanically affixed to the first rings 40*a*, and a second bracelet section 60*b* being affixed to an opposing end portion using the second ring portions 40*b*. The bracelet sections 60*a*, 60*b* are illustrated here comprising a chain-link construction using plastic or metal link elements and being joined together by a clasp 62 or equivalent means; however, it is understood that the alternate bracelet embodiment 50 may include various styles of bracelet sections 60*a*, 60*b* based upon a user's preference such as beaded-type, strap-type, rigid ring-type, or others, without being interpreted a limitation of scope.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 1 through 3*b*.

The method of installing and utilizing the preferred embodiment of the device 10 may be achieved by performing the following steps: procuring a model of the device 10 having a desired size, wrist plate indicia 24, and perimeter shape; selecting and/or purchasing a media panel 100 containing an inspirational or motivational message indicia 105; flexing the film panel 30 outwardly away from the plate 20 using one's fingers until in an open state; positioning the media panel 100 against a rear surface 23 of the plate 20 with the message indicia 105 facing outward; pressing inwardly upon the film panel 30 to have the film panel front surface 35 retain the media panel 100 against the plate 20; placing the device 10 in a readily observable location such as on a desk-top, within one's purse, in one's pocket, or the like; observing the message media 105 when desired; and, being motivated, inspired, or uplifted by the media panel 100, afforded a user of the present invention 10.

The method of utilizing the alternative embodiment 50 of the device 10 may be achieved by performing the following steps: installing a media panel 100 within the device 10 as described above; attaching the alternate bracelet embodiment portion 50 to one's wrist by wrapping the first bracelet section 60*a* and second bracelet section 60*b* around a user's wrist area; joining the bracelet sections 60*a*, 60*b* using the clasp 62; tilting the plate 20 outwardly from the user's wrist area to observe the message media 105 when desired to receive motivation, inspiration, or the like.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. An ornamental device, comprising:

a first member having a first front surface and a first rear surface, wherein:

said first member is rigid; and, at least said first rear surface is arcuate having a span, a first haunch section, and a second haunch section;

a second member having a second front surface and a second rear surface, wherein said second member comprises a flexible, resilient material;

a pair of fasteners connecting distal ends of said second member to distal ends of said first member enabling pivoting movement of distal sections of said second member relative to said first and second haunch sections;

wherein when said second member is compelled to flex towards said first rear surface, said second member bows and abuts said first and second haunch sections; and, wherein when said second member is compelled to flex away from said first rear surface, said second member bows and forms an arch substantially mirroring said first rear surface.

2. The device recited in claim 1, wherein said first rear surface and said second member share a similar perimeter shape.

3. The device recited in claim 2, wherein said second member is substantially rectangular.

4. The device recited in claim 1, wherein said first member is plastic.

5. The device recited in claim 1, wherein said second member is plastic.

6. The device recited in claim 1, wherein said first member is transparent.

7. The device recited in claim 1, wherein said second member is transparent.

8. The device recited in claim 1, wherein said fasteners comprise:

at least one aperture located at each distal end of said first member and said second member, wherein said apertures substantially align when said first member and said second member are arranged in a parallel manner and said second front surface is adjacent to said first rear surface; and, a ring passed through each aligned aperture.

9. The device recited in claim 8, wherein each ring is metal.

10. The device recited in claim 1, further comprising a border disposed on a perimeter edge of said second member.

11. The device recited in claim 10, wherein said border comprises a thin film metal.

12. A bracelet, comprising:

a first member having a first front surface and a first rear surface, wherein:

said first member is rigid; and, at least said first rear surface is arcuate having a span, a first haunch section, and a second haunch section;

a second member having a second front surface and a second rear surface, wherein said second member comprises a flexible, resilient material;

said second front surface faces said first rear surface;

a first pair of fasteners connecting distal ends of said second member to distal ends of said first member enabling pivoting movement of distal sections of said second member relative to said first and second haunch sections;

a first linkage section having a first connector end and a first clasping end;

a second linkage section having a second connector end and a second clasping end;

a second pair of fasteners, one of said second pair of fasteners mechanically connecting said first connector end to one of said first fasteners and the other of said second pair of fasteners mechanically connecting said second connector end to the other of said first fasteners; and, a clasp to removably fasten said first clasping end to said second clasping end;

wherein when said second member is compelled to flex towards said first rear surface, said second member bows and abuts said first and second haunch sections; and, wherein when said second member is compelled to flex away from said first rear surface, said second member bows and forms an arch substantially mirroring said first rear surface.

13. The bracelet recited in claim 12, wherein said first rear surface and said second member share a similar perimeter shape.

14. The bracelet recited in claim 13, wherein said second member is substantially rectangular.

15. The bracelet recited in claim 12, wherein said first member is plastic.

16. The bracelet recited in claim 12, wherein said second member is plastic.

17. The bracelet recited in claim 12, wherein said first member is transparent.

18. The bracelet recited in claim 12, wherein said second member is transparent.

19. The bracelet recited in claim 12, wherein said first fastener comprises:

at least one aperture located at each distal end of said first member and said second member, wherein said apertures substantially align when said first member and said second member are arranged in a parallel manner and said second front surface is adjacent to said first rear surface; and, a ring passed through each aligned aperture.

20. The device recited in claim 12, further comprising a border disposed on a perimeter edge of said second member.

* * * * *